US005301939A

United States Patent [19]

Ellsworth

[11] Patent Number: 5,301,939

[45] Date of Patent: Apr. 12, 1994

[54] BASKETBALL SAFETY FUNNEL

[76] Inventor: Cecil L. Ellsworth, 131 West 200 North, Hyrum, Utah 84319

[21] Appl. No.: 953,653

[22] Filed: Sep. 29, 1992

Related U.S. Application Data

[63] Continuation-in-part of Ser. No. 653,617, Feb. 11, 1991, abandoned.

[51] Int. Cl.[5] ..... A63B 63/08

[52] U.S. Cl. ..... 273/1.5 R

[58] Field of Search ..... 273/1.5 RA, 402; 141/331, 332, 337, 339, 341-343; D21/201

[56] References Cited

U.S. PATENT DOCUMENTS

| | | | |
|---|---|---|---|
| 1,544,453 | 6/1925 | Harbison | 273/1.5 R |
| 2,579,312 | 12/1951 | Garvey | 273/1.5 R |
| 3,109,647 | 11/1963 | Austin | 273/1.5 R |
| 3,752,477 | 8/1973 | Hoyt | 273/1.5 R |
| 3,761,089 | 9/1973 | Slane | 273/1.5 R |
| 4,353,548 | 10/1982 | Mahoney | 273/1.5 R |
| 4,834,368 | 5/1989 | Qualley | 273/1.5 R |
| 4,991,837 | 2/1991 | Deal | 273/1.5 R |

*Primary Examiner*—Paul E. Shapiro
*Attorney, Agent, or Firm*—Trask, Britt & Rossa

[57] ABSTRACT

Disclosed herein is a basketball safety funnel (10) formed of a body (12) constructed of transparent, imperforate, plastic material. The body (12) is funnel-shaped and includes a collar (18) attached to the upper edge (14) thereof. The collar (18) includes attachment members for attaching the funnel (10) to the rim (42) depending horizontally from a basketball backboard (44). In one embodiment, the attachment members comprise a plurality of openings (34) formed in the collar (18) sized and shaped to receive a flexible filament (22) that is attached to the hooks (46) depending from the rim (42). In another embodiment, rings (86) are placed through each of the openings (84) in the collar (82), and a cord (88) is passed through the rings (86) and looped over the hooks (90) on the rim (92). In yet another embodiment, the collar (18) includes a channel (36) formed therein that is sized and shaped to receive the flexible filament (22). Openings (34) in the channel (36) allow the flexible filament (22) to project out of the channel (36) and form loops that are attached to the hooks (46) on the rim (42). The transparent, plastic funnel (10) of the present invention replaces conventional netting that can cause serious injury due to entanglement therein, and is an economical replacement thereof.

17 Claims, 3 Drawing Sheets

BASKETBALL SAFETY FUNNEL

This is a continuation-in-part of prior copending U.S. patent application Ser. No. 07/653,617 filed on Feb. 11, 1991, abandoned.

TECHNICAL FIELD

The present invention pertains to basketball equipment, and, more particularly, to a basketball safety funnel and method for attaching the same to a basketball rim to reduce injuries and property damages related to the use of fabric basketball nets.

BACKGROUND OF THE INVENTION

In the sport of basketball, an inflated ball is thrown through a circular hoop or rim to score points. For a number of years, a woven fabric net in a tubular shape has been used to slow or alter the descent of the basketball through the rim. These nets are typically constructed of nylon or cotton cord material that is knotted approximately every two inches to form a funnel shape. When the net is hung from the basketball rim, the knotted material forms holes or spaces between the knots. A serious drawback to the use of these nets is injuries resulting from players' hands, fingers, teeth, etc., becoming entangled in the net as well as injuries resulting from falls incident to contact with the net.

Another disadvantage related to the use of fabric netting is that schools and other institutions with basketball courts must regularly replace basketball rims and backboards at substantial expense due to damage caused by individuals grasping the net, climbing on the net, or hanging from the net. For instance, climbing on or hanging from a net generally results in the basketball rim being bent downward, thus making it unusable for its intended purpose.

One proposed method for overcoming the foregoing disadvantages is constructing a net out of metal chain. However, these chains have the same configuration of the fabric nets, thus posing the identical problems and disadvantages as discussed above with respect to fabric nets. Furthermore, while the chain nets tend to be very durable, especially outdoors, injuries resulting from contact with these nets tend to be more severe. Further, these nets are subject to corrosion, requiring continual costly replacement.

U.S. Pat. No. 4,335,881 discloses a multi-sectional basket goal made of pliable plastic. The goal can be used for a variation of a basketball game. The goal does not hang from a basketball rim, and it cannot be used as a safe alternative to a conventional basketball net. U.S. Pat. No. 4,836,539 teaches an aiming apparatus for use in the game of basketball. The aiming device is used to assist players in aiming a basketball. This device has the disadvantage of obscuring the basketball net because it extends below the level of the conventional basketball net. This can result in interfering with the playing of the game and there is the risk of a player coming in contact with the device. Its principal purpose is to be used as a practice device, and it is not intended to be used while a basketball game is being played. Furthermore, it could not be used in league or regulation basketball games due to the altered perspective appearing to a visiting team. Thus, neither of the prior art devices disclosed above satisfies the need to provide a usable alternative to fabric or chain netting.

SUMMARY OF THE INVENTION

The present invention is directed to a basketball tube for attachment to a basketball rim, the tube comprising a plastic funnel body made of transparent plastic and means for attaching the funnel body to a basketball rim. In accordance with one embodiment of the invention, the attaching means includes a collar having a cord channel formed therein and a cord passing through the channel. Ideally, the cord is constructed of fabric, such as nylon or cotton, or it may be wire, cable or other suitably strong, durable material.

In accordance with another aspect of the present invention, a basketball apparatus is disclosed comprising a circular basketball rim of a first diameter, the rim having a plurality of depending net attachment hooks attached thereto; a basketball having a second diameter that is less than said first diameter of said basketball rim; and a safety device attached to and depending from the net hooks of the rim, the safety device comprising a funnel-shaped annular body made of a transparent plastic material and having an upper edge and a lower edge; the annular body having a third diameter at the upper edge that is substantially equal to the first diameter, a fourth diameter at the lower edge that is less than the first diameter and greater than the second diameter, the body tapering inwardly and downwardly from the upper edge to the lower edge; a plurality of small holes through the material of the body adjacent the upper edge, the small holes being sized to prevent insertion therein of any appendage of a person using the apparatus, the material being otherwise imperforate; and means for securing the body to the rim that passes through each of the small holes and are secured to the net hooks.

As will be readily appreciated from the foregoing, the present invention provides an advancement in safety over conventional fabric and chain nets. These prior art nets allow an individual to become entangled in the netting, thus causing potential injury to hands, fingers, and even teeth. In addition, those falling from contact with the prior art nets often injure themselves on the floor or the ground. By replacing these nets with a plastic funnel body, the risk of entanglement or the ability to hang from the cords or knots is eliminated. In addition, the plastic funnel body will not stretch or wear out with use, thus having an extended life compared to prior devices.

Furthermore, the availability of adjustable height basketball standards allows individuals of a shorter height and/or younger age to climb or grab on the prior art nets and allows their faces to contact that net. In addition, chain nets used as an all-weather alternative to the woven fabric net can adversely affect the life of a basketball passing therethrough. The plastic funnel body of the present invention eliminates these disadvantages and provides an effective, safe, economical, all-weather alternative. The present invention can also be imprinted or formed with colors, designs, logos, words or numbers. For instance, team names, mascots or school colors could be visible on the funnel body or the funnel body can be painted or printed to look like a prior art net. For aesthetics as well as visibility, the present invention can be made of colored, transparent plastic, thus enabling a player to see the funnel more clearly and yet not obscure a ball bouncing thereon or falling therethrough.

Finally, the present invention can also be used to further slow the descent of the basketball through the body by using a longer funnel body, a more tapered funnel body, or variations thereof. Slower descent of the basketball is an added safety advantage for small children or handicapped individuals. The funnel can also be sized to fit standard and non-standard basketball rims, such as children's toy basketball standards.

BRIEF DESCRIPTION OF THE DRAWINGS

The foregoing and other features and advantages of the present invention will be more readily appreciated as the same becomes better understood from reference to the detailed description when taken in conjunction with the following drawings, wherein.

DETAILED DESCRIPTION

Figure 1:
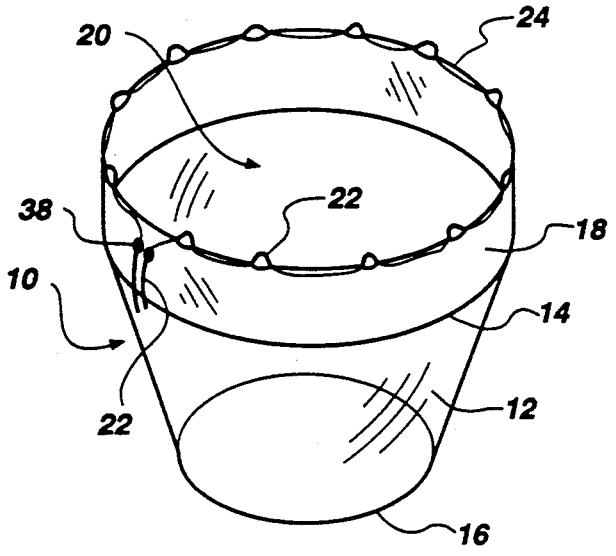
FIG. 1 is an isometric view of a basketball safety funnel formed in accordance with the present invention as attached to a conventional basketball rim.

Referring initially to FIG. 1, illustrated therein is a basketball safety funnel 10 formed in accordance with the present invention. The funnel 10 comprises a funnel-shaped annular body 12 having an annular upper edge 14 and an annular lower edge 16 with an annular collar 18 attached to the upper edge 14. The body 12 has an internal bore 20 defined by the annular upper edge 14 and the annular lower edge 16. The diameter of the annular upper edge 14 is greater than the diameter of the annular lower edge 16 such that the body 12 tapers longitudinally inward from the upper edge 14 to the lower edge 16.

The collar 18 has a flexible filament 22 passing therethrough to facilitate attachment of the safety funnel 10 to a basketball rim. Inasmuch as the present invention is designed for use in the game of basketball, the diameter of the annular collar 18 and annular upper edge 14 as well as the annular lower edge 16 should be of sufficient dimension to allow a regulation-size basketball to pass therethrough. Ideally, the length along the axis of the longitudinal bore 20 is approximately eight inches between the upper edge 14 and lower edge 16 of the body 12. The collar 12 ideally measures four inches from the open edge 24 to the upper edge 14 of the body 12 and has a circumference approximately equal to the circumference of a standard basketball rim, which is approximately 58 inches. However, it is to be understood that the safety funnel 10 can be manufactured to accommodate the circumference of any standard or nonstandard basketball rim. Finally, the circumference of the lower edge 16 of the body 12 is approximately 34 inches, but can be of any size to permit a ball to pass through the body 12.

In the preferred embodiment, the body 12 is constructed of a durable, flexible imperforate material, such as plastic, having a thickness in the range of 15 mils to 35 mils. However, it is to be understood that a heavier material can be used for outdoor use where there is exposure to the elements.

Figure 2:
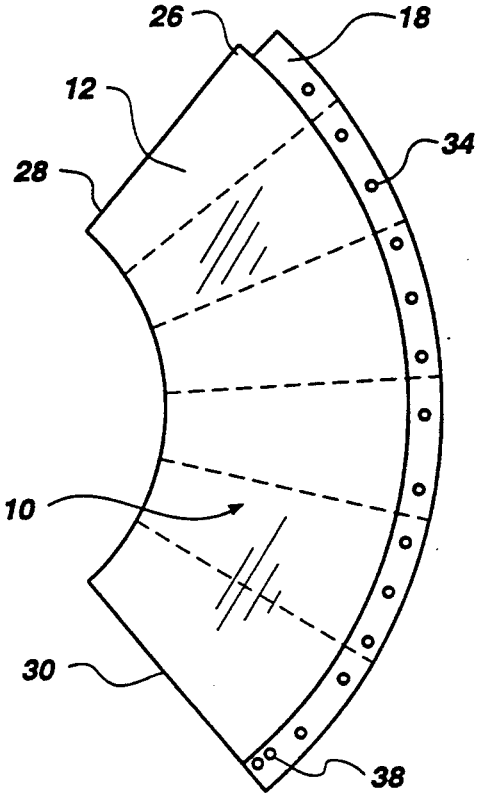
FIG. 2 is a plan view of an unassembled funnel body formed in accordance with the present invention.

Referring next to FIG. 2, shown therein is a plan view of the unfolded body 12 and collar 18. The body 12 includes a seam allowance 26, in this case approximately one inch, for formation of a seam when the body 12 is assembled. More particularly, the two lateral sides 28 and 30 are brought together with the seam allowance 26 overlapping the one lateral side 30. These sides can be joined by gluing, sewing, welding, or other conventional methods for holding the material together to form the lower funnel-shaped body 12 as shown in FIG. 1.

Figure 3:
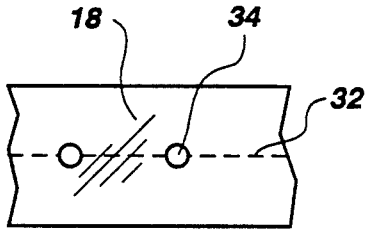
FIG. 3 is a plan view of a portion of a collar in an unfolded configuration.
Figure 4:
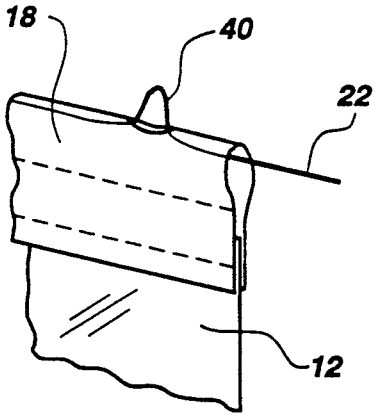
FIG. 4 is an isometric view of a portion of the collar assembled in accordance with the present invention.

The collar 18 is in an unassembled form, as is shown more particularly in FIG. 3. The collar 18 consists of a flat sheet of transparent, preferably, plastic material cut to approximately an eight-inch width and having a center line 32. Openings 34 are formed at spaced intervals along the center line 32 of the collar 18. The openings 34 are positioned so that when the collar 18 is attached to the funnel body 12, the openings 34 will match the configuration of hooks on a basketball rim. As shown more particularly in FIG. 4, the collar 18 is folded about the center line 32 and attached to both sides of the upper edge 14 of the body 12. This forms a channel 36 around the upper edge 14 of the body 12 with the openings 34 positioned at the top thereof. The flexible filament 22, such as a cord, cable, string, or other suitable cable-like material, is passed through the channel 36 as shown in FIG. 4 and out through side openings 38, as shown more clearly in FIG. 1. Portions of the flexible filament 22 are then pulled up through the openings 34 to form loops 40, as shown in FIG. 4.

Figure 5:
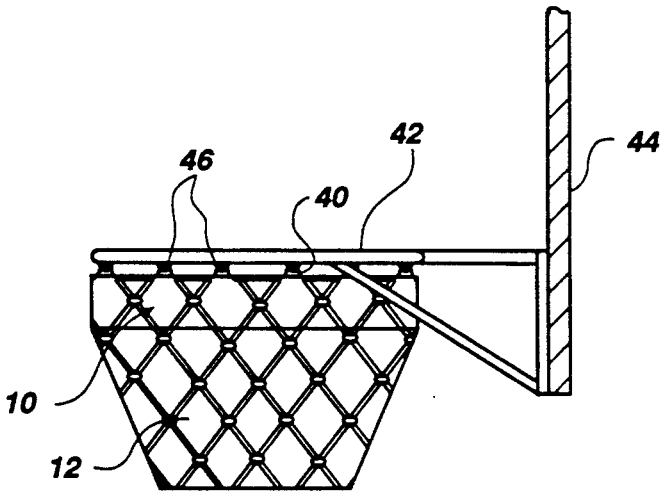
FIG. 5 is a side view of the basketball safety funnel formed in accordance with the present invention as attached to a conventional basketball rim.

Referring next to FIG. 5, the assembled safety funnel 10 is shown attached to an existing basketball rim 42, which in turn is attached to a conventional backboard 44. The rim 42 includes a plurality of spaced-apart hooks 46 formed in a conventional manner. Each loop 40 of flexible filament 22 is placed over the corresponding hook 46 on the rim 42 so that the funnel 10 depends downward from the rim 42.

Figure 6:
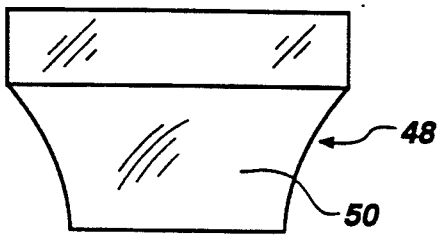
FIG. 6 is a side view of an alternative embodiment of a basketball safety funnel formed in accordance with the present invention.

Referring next to FIG. 6, an alternative embodiment of a basketball safety funnel 48 formed in accordance with the present invention is shown therein. In this embodiment, the body 50 of the funnel 48 curves concavely inward. This inward curvature of the funnel body 50 acts to further dampen the impact of the basketball within the funnel 48 and to slow the descent of the basketball therethrough. In similar fashion, the sides of the body 50 could also be outwardly curved or convexly curved.

Figure 7:
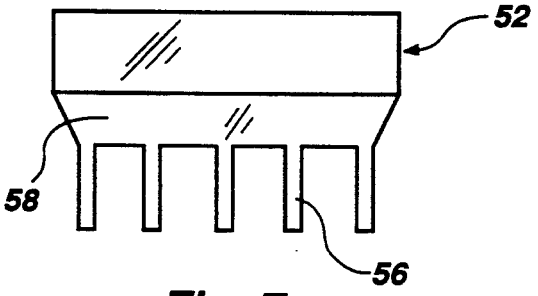
FIG. 7 is a side view of an alternative embodiment of a basketball safety funnel formed in accordance with the present invention.

FIG. 7 is another alternative embodiment of a basketball safety funnel 52 formed in accordance with the present invention. As shown therein, the body 54 has a plurality of strips 56 depending downward from the central region 58 of the body 54. These strips 56 provide a different aesthetic appearance.

Figure 8:
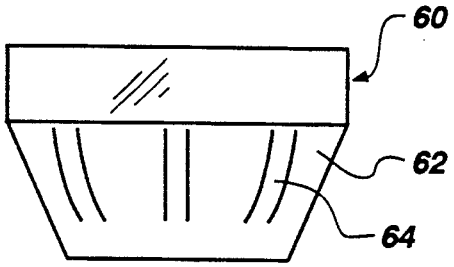
FIG. 8 is a side view of an alternative embodiment of a basketball safety funnel formed in accordance with the present invention.
Figure 9:
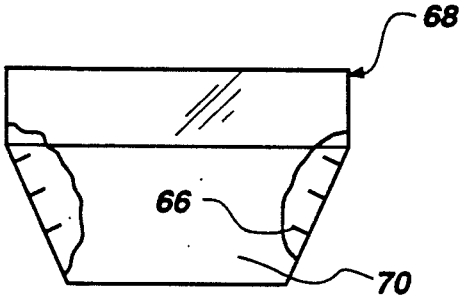
FIG. 9 is a side view of an alternative embodiment of a basketball safety funnel formed in accordance with the present invention.

FIG. 8 also depicts another alterative embodiment of a basketball safety funnel 60 wherein the body 62 includes a plurality of outward-expanding vertical pockets 64 formed therein. These pockets 64 are formed to flex or bulge outwardly, thus slowing the horizontal spin of a basketball as it passes through the body 62. Dampening movement of the basketball can also be accomplished by forming a plurality of inward extensions 66 inside the funnel body 70, as shown in the alternative embodiment of the basketball safety funnel 68 depicted in FIG. 9. The extensions 66 depend inwardly from the body 70 of the funnel 68 to slow the horizontal spin of the basketball as it passes therethrough. For ease of illustration these extensions 66 are depicted as tabs, but it is to be understood that the extensions may also be bristles, ridges, or the like.

Figure 10:
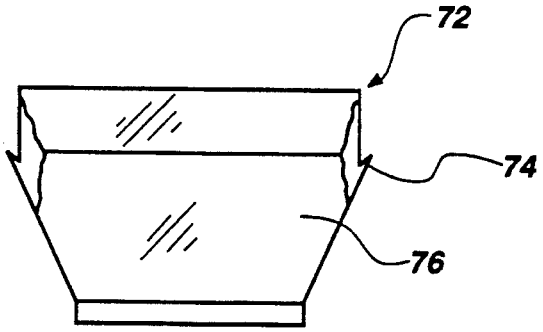
FIG. 10 is a side view of an alternative embodiment of a basketball safety funnel formed in accordance with the present invention.

Turning to FIG. 10, also illustrated therein is another alternative embodiment of a basketball safety funnel 72 formed in accordance with the present invention, wherein an annular pleat 74 is formed in the body 76 to allow expansion of the body 76 as a basketball passes therethrough. This pleat is adapted to expand downwardly as the basketball passes through the funnel body. In other words, the weight of the basketball causes the pleat to expand downwardly. This acts to further slow the downward movement of the basketball as it passes through the funnel body 76. Additional pleats may also be used.

Figure 11:
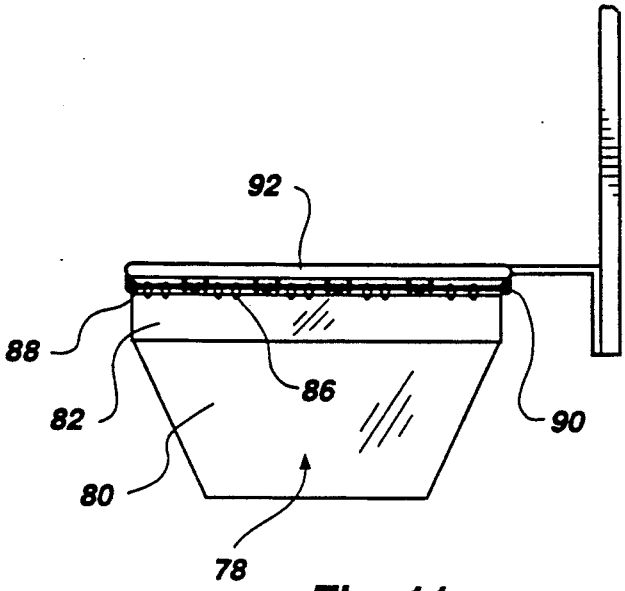
FIG. 11 is a side view of a basketball safety funnel hoop and alternative mounting method formed in accordance with the present invention.

Attachment of the basketball safety funnel to a basketball rim can also be accomplished by other means. For instance, another representative embodiment of the present invention is depicted in FIG. 11, which shows a basketball safety funnel 78 that includes a body 80 having a collar portion 82 formed at the top thereof. As shown more clearly in FIG. 12, this collar 82 is formed of thicker material than the body 80, such as a doubling over of the body material 80 or being formed of plastic of 30 mil to 70 mil. A plurality of openings 84 are formed at spaced-apart intervals in the collar 82. Passing through each of these openings is a ring 86, and through these rings is passed a flexible filament or cord 88. The cord 88 is placed on the hooks 90 on the basketball rim 92 so that the funnel 78 will depend from the rim 92.

Figure 12:
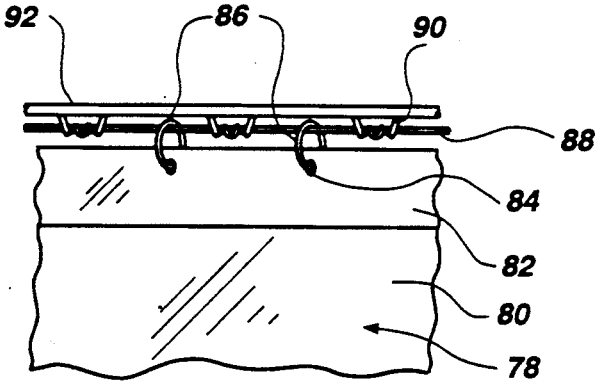
FIG. 12 is an enlarged side view of a portion of the net collar and basketball rim of FIG. 11.
Figure 13:
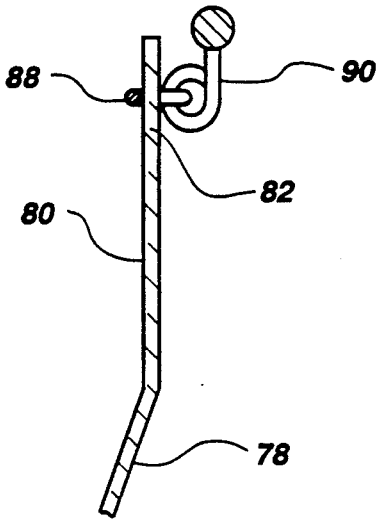
FIG. 13 is a cross-sectional view of an alternative method for mounting the basketball safety funnel of FIG. 11.

Depicted in FIG. 13 is yet another alternative embodiment for mounting the basketball safety funnel to a basketball rim 94. For convenience, the other reference numbers used in conjunction with the embodiment depicted in FIGS. 11 and 12 are used in the embodiment depicted in FIG. 13. As shown herein, the cord 88 is passed directly through the openings 84 in the collar 82 of the embodiment depicted in FIGS. 11–12. The cord 88 is then looped over the hooks 90 of the rim 92 depicted in FIGS. 11 and 12, thus eliminating the need for the rings 86.

While a representative embodiment of the invention has been illustrated and described along with alternative embodiments, it is to be understood that yet other changes can be made in the invention without departing from the spirit and scope thereof. For instance, the rings 86 depicted in FIGS. 11 and 12 can be placed directly on the hooks 90 without the need for the cord 88. Furthermore, the funnel body can be formed from any pliable material cut in a fan shape and joined at the sides by welding or gluing. In the alternative, the entire body may be formed as a one-piece seamless unit by vacuforming, thermo-forming, injection molding, or other techniques to produce a funnel-shaped tube of transparent or translucent material.

The preferred embodiments of the invention in which an exclusive property or privilege is claimed are defined as follows:

1. A basketball apparatus for use with a basketball having a first diameter, said basketball apparatus comprising:

a circular basketball rim of a second diameter that is larger than the first diameter of the basketball, said rim having a plurality of attachment hooks depending therefrom;

a safety device attached to and depending from said attachment hooks of said rim, said safety device comprising a funnel-shaped annular body made of a transparent plastic material and having an upper edge and a lower edge;

said annular body having at said upper edge a third diameter substantially equal to said second diameter, a fourth diameter at said lower edge less than said third diameter and greater than said diameter of said basketball, said body tapering inwardly and downwardly from said upper edge to said lower edge;

a plurality of small openings formed through the material of said body adjacent said upper edge, said openings being sized and shaped to prevent insertion therein of any appendage of a person using said apparatus, said material of said body being otherwise imperforate; and means for securing said body to said rim, said securing means passing through each of said small holes and secured to said hooks on said rim.

2. The apparatus of claim 1, wherein said securing means comprises a flexible filament.

3. The apparatus of claim 1, wherein said securing means comprises a plurality of individual attachment members, each attachment member passing through a single opening and attached to a single hook on said rim.

4. The apparatus of claim 3, wherein said attaching members comprise rings.

5. A basketball safety funnel for use with a conventional basketball rim, the rim having a plurality of attachment hooks depending therefrom, the funnel comprising:

a body formed of transparent, substantially imperforate plastic material; and means for attaching said body to the attachment hooks on the basketball rim.

6. The funnel of claim 5, wherein said attaching means comprises a plurality of openings formed in said body sized and shaped to receive a flexible filament passing therethrough.

7. The funnel of claim 5, wherein said attaching means comprises a plurality of openings formed in said body and each opening being sized and shaped to receive an attachment member and a flexible filament passing through said attachment members and attached to the hooks on the basketball rim.

8. The funnel of claim 5, wherein said attaching means comprises a plurality of openings formed in said funnel body that are sized and shaped to each receive an attachment member that is configured for attachment to the hook on the basketball rim.

9. The funnel of claim 5, wherein said attachment means comprises a channel formed along an upper edge of said body sized and shaped to receive a flexible filament, said channel having a plurality of spaced-apart openings formed along an upper edge thereof sized and shaped to allow a portion of said flexible filament to project outward therefrom to form a loop for attachment to the hook on the basketball rim.

10. A basketball tube for use with a basketball rim having a plurality of hooks depending therefrom, said tube comprising:

(a) a body formed of transparent, substantially imperforate plastic material;

(b) means for attaching said body to the basketball rim; and (c) means for slowing the descent of a basketball through said body.

11. The tube of claim 10, wherein said slowing means comprises outward extensions formed on said body.

12. The tube of claim 11, wherein said outward extensions comprise bulges of material on said body.

13. The tube of claim 11, wherein said outward extensions comprise one or more pleats formed on said body.

14. The tube of claim 10, wherein said slowing means comprises inward extensions formed on said body.

15. The tube of claim 14, wherein said inward extensions comprise tabs depending inward from said body.

16. The tube of claim 14, wherein said inward extensions comprise a plurality of bristles depending inward from said body.

17. The tube of claim 10, wherein said body is imprinted to appear as a conventional basketball net.

* * * * *